US006019623A

United States Patent [19]

Ito et al.

[11] Patent Number: 6,019,623

[45] Date of Patent: Feb. 1, 2000

[54] TERMINAL DEVICE FOR AN IC CARD

[75] Inventors: Shinju Ito, Naka-gun; Yuhei Abe, Hitachinaka, both of Japan

[73] Assignee: Hitachi, Ltd., Toyko, Japan

[21] Appl. No.: 08/939,494

[22] Filed: Sep. 29, 1997

[30] Foreign Application Priority Data

Sep. 30, 1996 [JP] Japan ..... 8-258265

[51] Int. Cl.[7] ..... H01R 4/60

[52] U.S. Cl. ..... 439/206; 235/380

[58] Field of Search ..... 439/205, 206, 439/59, 630, 636, 637, 631; 235/380, 482

[56] References Cited

U.S. PATENT DOCUMENTS

| | | | |
|---|---|---|---|
| 4,871,905 | 10/1989 | Mita et al. | 235/475 |
| 5,296,692 | 3/1994 | Shino | 235/486 |
| 5,380,997 | 1/1995 | Hania et al. | 235/485 |
| 5,424,520 | 6/1995 | Lee | 235/380 |
| 5,811,770 | 9/1998 | Bonnemoy | 235/380 |

*Primary Examiner*—Khiem Nguyen
*Assistant Examiner*—Michael C. Zarroli
*Attorney, Agent, or Firm*—Antonelli, Terry, Stout & Kraus, LLP

[57] ABSTRACT

A terminal device for reading and/or writing electronic information from and/or into an IC card (100) inserted therein, comprises: electric connection terminals (12) through which the electronic information including electronic money is read out from said IC card and/or is written into said IC card; and a card insertion opening (50) provided on a top surface of a main body(10) of the terminal device, into which said IC card (100) is inserted, wherein the card insertion opening (50) is formed penetrating from the top surface of the terminal device up to a bottom surface thereof so as to discharge dust and/or dirt coming inside from the card insertion opening (50) automatically.

7 Claims, 6 Drawing Sheets

TERMINAL DEVICE FOR AN IC CARD

BACKGROUND OF THE INVENTION

1. Field of the Invention

The present invention relates to a terminal device for reading and/or writing electronic information into and/or from an IC card inserted, in which the electronic information is and/or to be memorized.

2. Description of Related Art

As an example of conventional technique, Japanese Utility Model Laying-Open No. Hei 1-144957 (1989) titled "A reader and writer with a covering door for use in a IC card" was already known. However, in the device according to such the prior art, though consideration is paid against dust and/or dirt, various parts relating the covering door and others thereof must be added, thereby rising up the production cost thereof. Further, with the construction thereof, it is also difficult to remove the dust and/or dirt which comes inside once therein.

SUMMARY OF THE INVENTION

An object of the present invention is to provide a terminal device for reading and/or writing information to from an IC card, thereby while avoiding the drawback of the prior art mentioned above.

For accomplishing the object mentioned above, in accordance with the present invention, there is provided a terminal device for reading and/or writing information from and/or into an IC card inserted therein, comprising:

electric connection terminals through which the information is read out from said IC card and/or is written into said IC card; and a card insertion opening into which said IC card is inserted, wherein said card insertion opening is formed, penetrating from a surface on which said card insertion opening is provided up to one of surfaces of said terminal device other than said surface on which said card insertion opening is provided.

Further, according to the present invention, in the terminal device as defined in the above, said card insertion opening is opened onto a reverse side surface of said terminal device, being opposite to said surface on which said card insertion opening is provided.

Further, according to the present invention, in the terminal device as defined in the above, said card insertion opening is opened onto one of side surfaces of said terminal device adjacent to said surface on which said card insertion opening is provided.

Moreover, accomplishing the object mentioned above, in accordance with the present invention, there is also provided a terminal device for reading and/or writing information from and/or into an IC card inserted therein, comprising:

electric connection terminals through which the information is read out from said IC card and/or is written into said IC card; and a card slot member having a card insertion opening being formed at one edge thereof, into which said IC card is inserted, wherein a stopper is formed partially at the other opposite end of said card slot member so as to dispose said inserted IC card at a predetermined position within said card insertion opening.

Further, according to the present invention, in the terminal device as defined in the above, said stopper is formed so as to close the card insertion opening in part at the other opposite end of said card slot member.

Further, according to the present invention, in the terminal device as defined in the above, said stopper is formed by extending a portion of interior wall surface of said card slot member toward opposite interior wall surface thereof halfway.

DESCRIPTION OF THE PREFERRED EMBODIMENTS

Hereinafter, detailed explanation of the embodiments according to the present invention and comparisons will be given by referring attached drawings.

Figure 1:
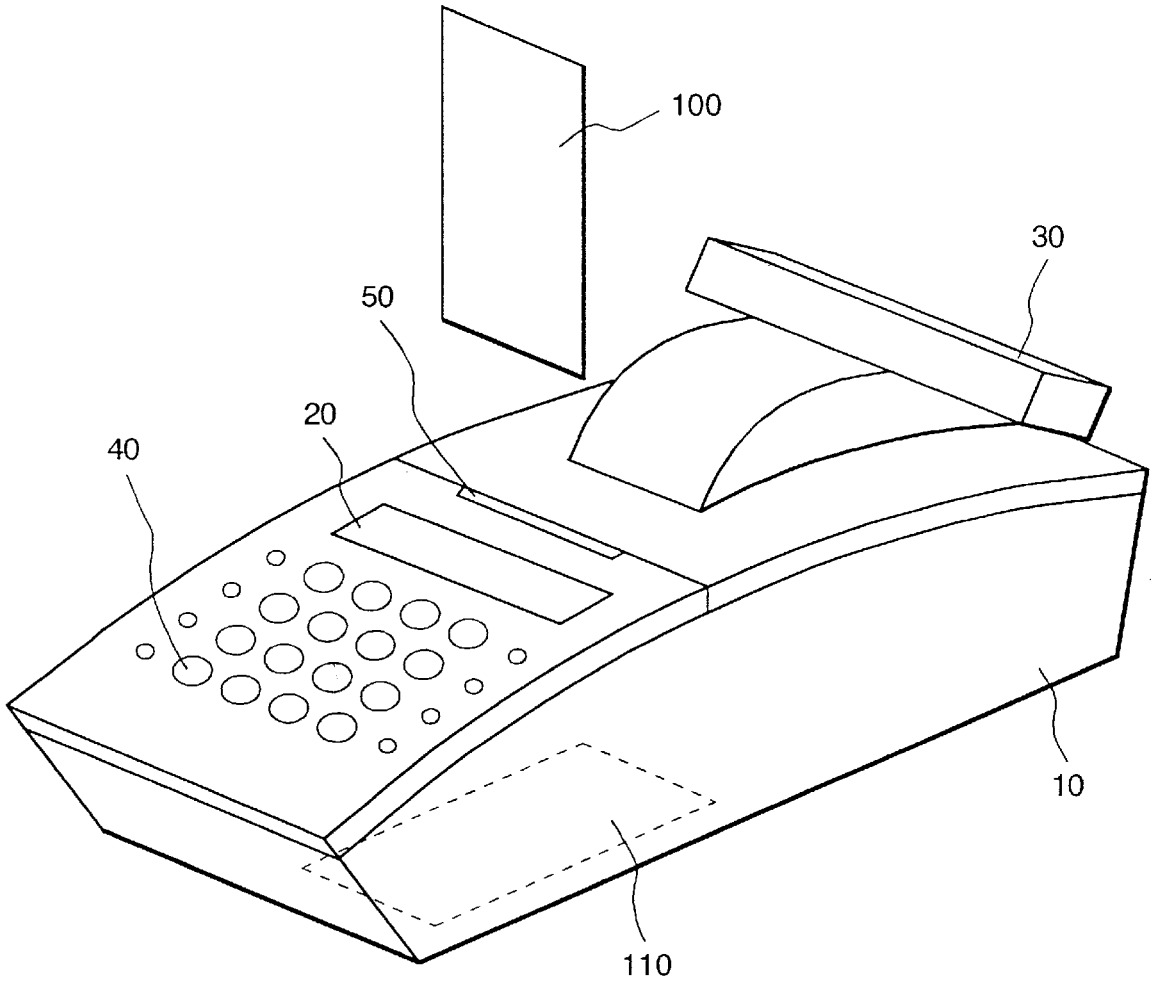
FIG. 1 shows a perspective view of external appearance of a terminal device for an IC card as an embodiment in accordance with the present invention.

FIG. 1 shows perspective view of external appearance of a terminal device for an IC card in accordance with the present invention, wherein the terminal device for an IC card has a main body 10 thereof, a display portion 20 for a clerk of store or shop, a display 30 for a customer, and a ten-key buttons 40. On the main body 10 is provided a card insertion opening 50 from and into which the IC card can be inserted. With this device, a total amount of purchases which the customer wishes to buy can be displayed on both the display portion 20 and the display portion 30, for the clerk as well as the customer to ascertain it, for example, by operation of the ten-key buttons 40 by the clerk. Further, by inserting the IC card 100 owned by the customer into the card insertion opening 50, electronic data of information (electronic money) corresponding to the amount of money of the article bought by the customer is transferred, from the IC card 100 in which the electronic money is previously memorized, to the IC card 110 owned by the store or shop.

Figure 2:
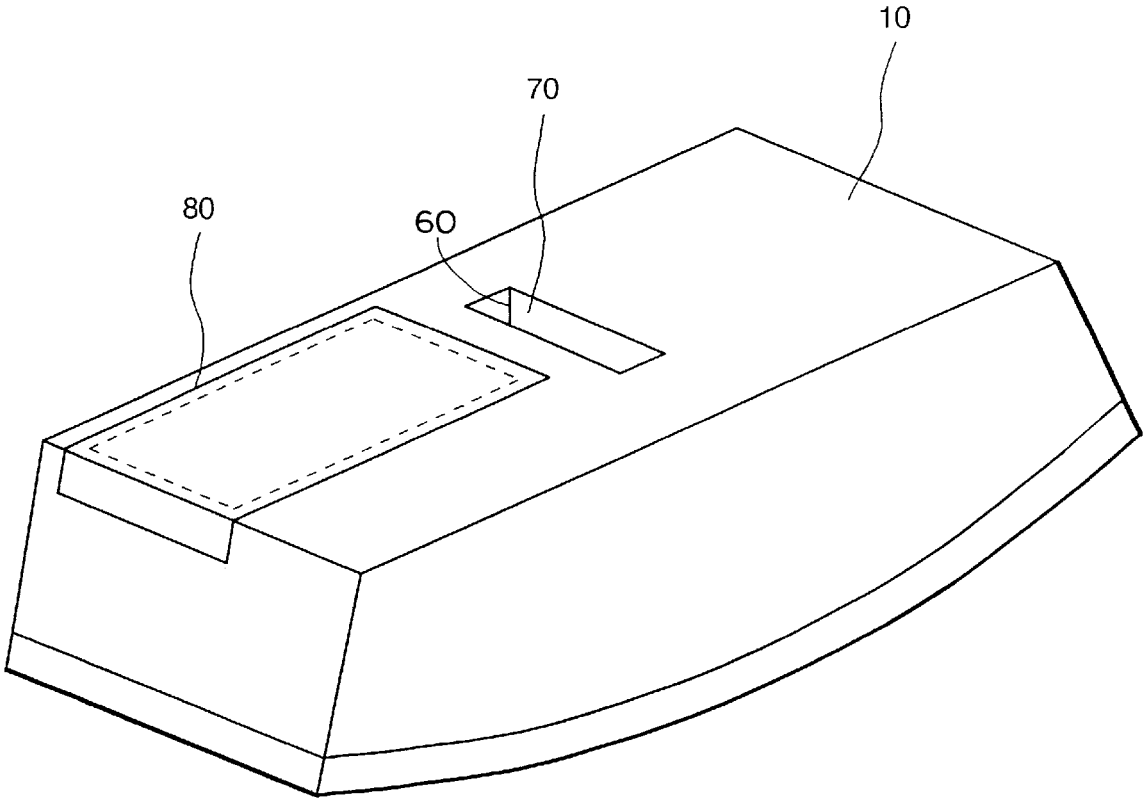
FIG. 2 shows also a perspective view of the terminal device for an IC card but from the reverse side thereof.

From FIG. 2 showing external perspective view of the terminal device for an IC card from opposite or reverse side thereof, it is apparent that there are provided a penetrating opening 70 communicating or connecting with the card insertion slot opening 50 via a containment duct 60 providing a substantially unimpeded path for allowing contaminants to be contained and directed to exit to an outside of the device, and a cover 80 for the IC card of the store, on the main body 10 of the device.

Figure 3:
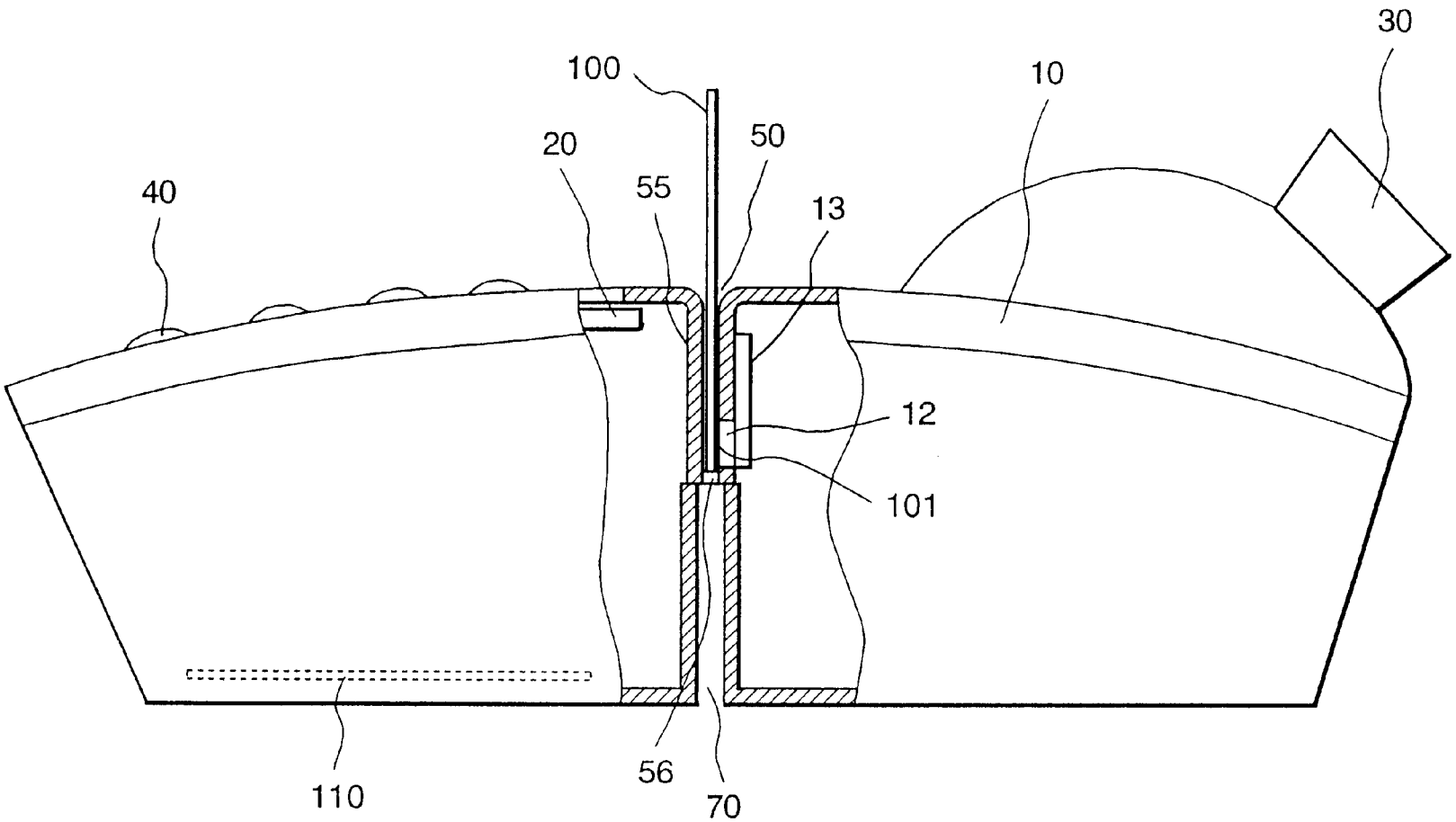
FIG. 3 shows a cross-sectional view of the terminal device for an IC card.

Next, referring to FIG. 3 showing the cross-sectional view of the terminal device for an IC card, a substrate 13 having terminals 12 is positioned inside of the main body 10, therefore, the terminals 12 of the substrate 13 are brought into contacting condition with terminals 101 provided on a surface of the IC card 100 of the customer to read out contents of the IC card, by inserting it into or from the card insertion opening 50. The IC card 100 of the customer which is inserted from the card insertion opening 50 is stopped at a predetermined position by a stopper 56 provided in a card slot 55. However, the stopper 56 is provided or formed only in part inside of the card slot 55, as will be explained in more detail later, then the card insertion opening 50 and the penetrating opening 70 are still communicated or connected with each other via the containment about 60. Therefore, dust and/or dirt which comes inside once from the card insertion slot opening 50 is automatically discharged outside of the main body, from or through the penetrating opening 70 provided on the bottom surface.

Figure 4:
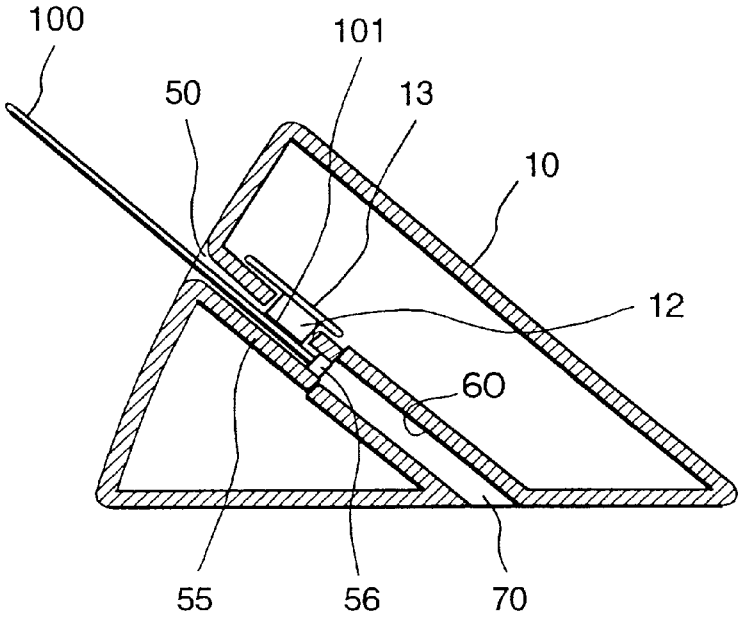
FIG. 4 shows also a cross-sectional view of the terminal device for an IC card but relating to another embodiment of the present invention.
Figure 5:
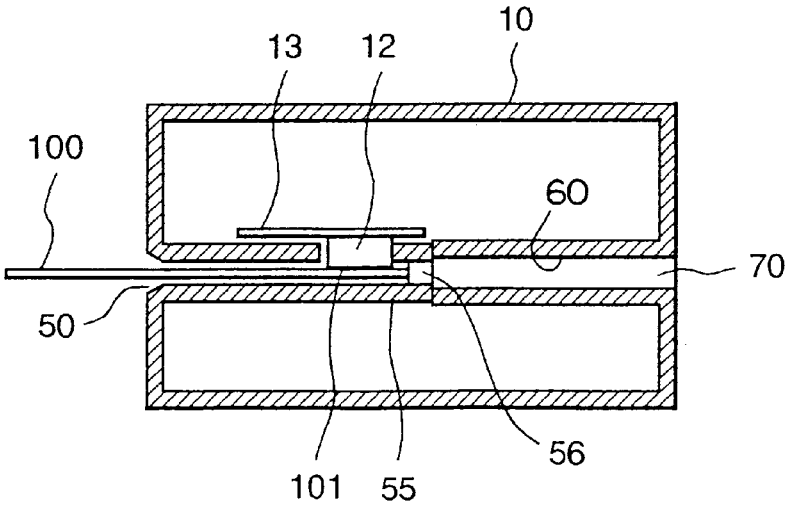
FIG. 5 shows also a cross-sectional view of the terminal device for an IC card but relating to further another embodiment of the present invention

In FIGS. 4 and 5 showing the terminal device for an IC card relating to other embodiments of the present invention, the card insertion opening 50 is positioned on a inclined surface or on a vertical surface, respectively. Because the card insertion opening 50 is formed penetrating through the main body, the dust and/or dirt which come inside once hardly remain therein and easily ca be removed if remaining therein, for example, by introducing an air blow into the card insertion opening 50 from one side thereof.

In accordance with the embodiment fully explained hereinbefore, since the card insertion opening is formed on the main body of the terminal device in such that it penetrates up to the opposite or reverse surface thereof, the dust and/or dirt coming inside is automatically discharged from or through the penetrating opening opened on the reverse surface or the side surface of the main body. Thereby, the dust and/or dirt coming inside once can hardly remain therein. And, if the dust and/or dirt remains inside, it can be blown away from the card insertion opening by introducing air into one end thereof.

Figure 6:
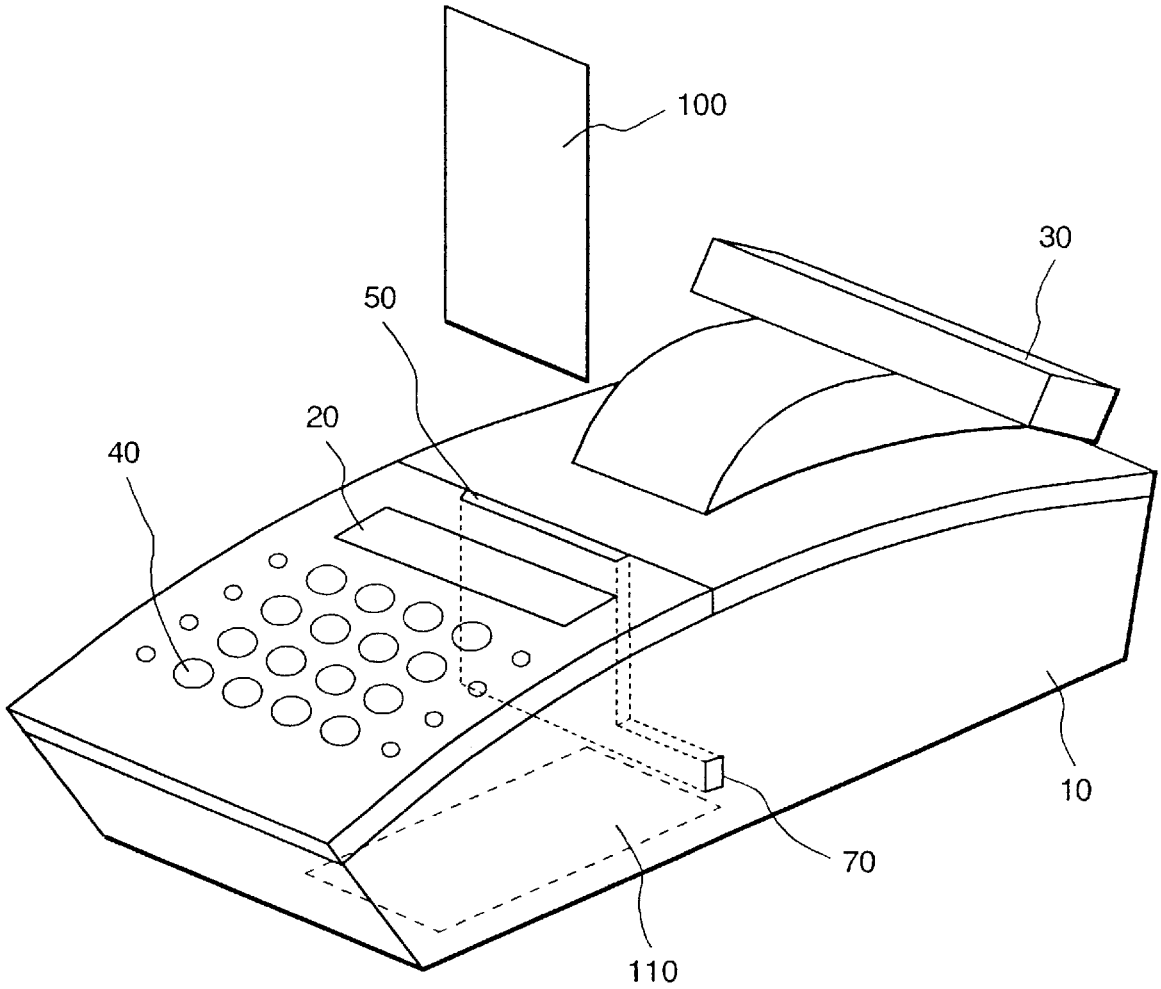
FIG. 6 shows a perspective view of external appearance of a variation of the terminal device in accordance with the present invention shown in FIG. 1 and showing a variation in the arrangement of the opening 70.

However, in the embodiments mentioned above, it is explained that the penetrating opening 70 which is connected from the card insertion opening 50 is opened onto the opposite or reverse surface, i.e., bottom surface of the terminal device, however, it should not be restricted to that mentioned above, in accordance with the present invention. Namely, the penetrating opening 70 can be made open, for example, onto any one side surface of four (4) side surfaces of the main body of the terminal device, as shown in FIG. 6, i.e., on the side surface being adjacent to the top surface on which the card insertion opening 50 is formed.

Further, in accordance with the present invention, in place of the various embodiments mentioned above, it is also possible to let the dust and/or dirt coming inside fall automatically downward to be discharged from the lower edge of the card slot 55, for example, by forming the stopper 56 in part of the opening at the lower edge of the card slot 55, so as to close in part at the other edge portion of the card insertion opening 50.

Figure 7:
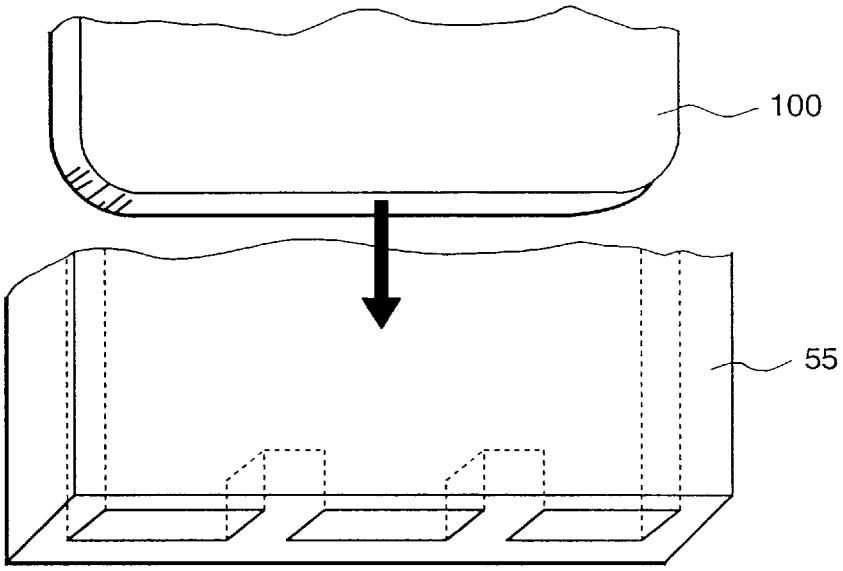
FIG. 7 shows an enlarged perspective view of a stopper of a card slot, showing exemplary construction thereof, in the terminal device for an IC card mentioned above.

As an exemplary construction of the stopper 56 partially formed within the card slot 55, for example, the stoppers 56 are formed at every predetermined distance therebetween in comb teeth fashion, as shown in FIG. 7.

Figure 8:
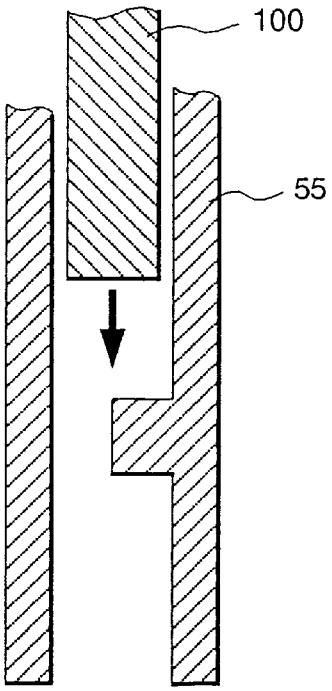
FIG. 8 shows an enlarged cross-sectional view of an another stopper of the card slot, showing exemplary construction thereof, in the terminal device for an IC card mentioned above.

Further, in place of this, the stopper 56 can be formed by extending or projecting a portion of interior wall surface of the card slot 55 toward opposite interior wall surface thereof halfway, as shown in FIG. 8.

As is fully explained in the above, in accordance with the present invention, it is possible to provide the terminal device for an IC card, in which dust and/or dirt coming inside from the card insertion opening hardly remain(s) inside thereof.

What is claimed is:

1. A terminal device for reading and writing information from and into an IC card inserted therein, comprising:

electric connection terminals through which the information is read out from said IC card and/or is written into said IC card; and a card insertion opening into which said IC card is inserted, wherein said card insertion opening penetrates from a surface on which card insertion is performed and includes a containment duct providing a substantially unimpeded containment path for allowing contaminants to be expelled substantially unimpeded to outside of said terminal device other than said surface on which said card insertion is performed, said containment duct adapted to contain and direct contaminants to exit to the outside of said terminal device.

2. A terminal device as defined in claim 1, wherein said card insertion opening is opened onto a reverse side surface of said terminal device, being opposite to said surface on which said card insertion opening is provided.

3. A terminal device as defined in claim 1, wherein said card insertion opening is opened onto one of side surfaces of said terminal device adjacent to said surface on which said card insertion opening is provided.

4. A terminal device for reading and writing information from and into an IC card inserted therein, comprising:

electric connection terminals through which the information is read out from said IC card and/or is written into said IC card; and a card slot member having a card insertion opening being formed at one edge thereof, into which said IC card is inserted, wherein a stopper is formed partially at the other opposite end of said card slot member so as to dispose said inserted IC card at a predetermined position within said card insertion opening; and a containment duct providing a substantially unimpeded path for allowing contaminants to be expelled substantially unimpeded to outside of said terminal device other than said surface on which said card insertion is performed, said containment duct adapted to contain and direct contaminants to exit to the outside of said terminal device; and wherein an opening of the partially formed said stopper opens into said containment duct.

5. A terminal device as defined in claim 4, wherein said stopper is formed so as to close the card insertion opening in part at the other opposite end of said card slot member.

6. A terminal device as defined in claim 4, wherein said stopper is formed by extending a portion of interior wall surface of said card slot member toward opposite interior wall surface thereof halfway.

7. A terminal device as defined in claim 1, wherein at least said containment duct of said card insertion opening is one of inclined and vertical such that gravity assists in moving said contaminants to exit to the outside of said terminal device.

* * * * *